US007921901B2

(12) United States Patent
Shin et al.

(10) Patent No.: US 7,921,901 B2
(45) Date of Patent: Apr. 12, 2011

(54) SACRIFICIAL SLEEVES FOR DIE CASTING ALUMINUM ALLOYS

(75) Inventors: Jongcheol Shin, Kyonggi-Do (KR); Jongwon B Park, Incheon (KR); Inwook Hwang, Daejeon (KR); Bob R. Powell, Jr., Birmingham, MI (US); Thomas A. Perry, Bruce Township, MI (US); Anil K. Sachdev, Rochester Hills, MI (US); Jon T. Carter, Farmington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 373 days.

(21) Appl. No.: 12/103,755

(22) Filed: Apr. 16, 2008

(65) Prior Publication Data

US 2009/0260774 A1 Oct. 22, 2009

(51) Int. Cl.
*B22D 29/00* (2006.01)

(52) U.S. Cl. ..... 164/132

(58) Field of Classification Search ..... 164/464, 164/465, 69.1, 70.1, 130–132, 421, 332, 164/98–112

See application file for complete search history.

(56) References Cited

U.S. PATENT DOCUMENTS

| | | | | |
|---|---|---|---|---|
| 5,558,151 | A | 9/1996 | Gilbert et al. | |
| 2005/0072395 | A1 | 4/2005 | Bilger et al. | |
| 2006/0108089 | A1 * | 5/2006 | Yoshihara et al. | 164/98 |
| 2008/0236536 | A1 * | 10/2008 | Jensen et al. | 123/193.5 |

FOREIGN PATENT DOCUMENTS

| | | |
|---|---|---|
| JP | 2002339794 | 11/2002 |

OTHER PUBLICATIONS

Peter Krug et al., New Aluminum Alloys for Cylinder Liner Applications, SAE Technical Paper Series, 2006-01-0983; Apr. 2006; Detroit, MI.

Written Opinion & International Search Report for PCT/US09/039608, Jul. 29, 2009, 7 pages.

* cited by examiner

*Primary Examiner* — Jessica L Ward
*Assistant Examiner* — Steven Ha
(74) *Attorney, Agent, or Firm* — Reising Ethington P.C.

(57) ABSTRACT

Some die cast aluminum alloy articles have internal cylindrical surfaces such as the round internal cylinder surfaces of a cylinder block for an internal combustion engine. During casting solidification molten aluminum alloys shrink against the metallic permanent mold tools used to mold and define such internal surfaces, and tend to stick to the tool surfaces making it difficult to remove the casting. The tendency of some aluminum casting alloys to solder to the tool can further intensify sticking. In this invention, an aluminum alloy sleeve is placed on and over the tool surface before casting and the sleeve isolates the tool from the molten aluminum. The sleeve becomes bonded to the casting and facilitates removal of the casting from the tool. The sleeve may be (and preferably is) fully machined from the internal casting surface. The sleeve may be of the same composition as the casting, in which case handling and recycling of machining chips would be facilitated. The practice of the invention is also applicable to die casting of magnesium alloys using magnesium sacrificial sleeves.

10 Claims, 2 Drawing Sheets

SACRIFICIAL SLEEVES FOR DIE CASTING ALUMINUM ALLOYS

TECHNICAL FIELD

This invention pertains to pressurized casting of aluminum alloy articles having internal cylindrical surfaces, especially surfaces that are shaped by casting a molten aluminum alloy against one or more metal permanent mold tool surfaces and later separating the mold surfaces from the surface(s) of the solidified aluminum article. In an illustrative embodiment, this invention relates to the use of sacrificial aluminum alloy sleeves placed on or over the mold tool surfaces in preparation for high pressure die casting of aluminum alloy engine cylinder blocks with several cylinder bores per casting.

BACKGROUND OF THE INVENTION

Multi-cylinder engine blocks have long been produced by casting processes and then machined and assembled into reciprocating piston, internal combustion engines for automotive vehicles and for other power requirements. The cast engine blocks including the cylinder internal diameters or surfaces (sometimes called "cylinder bores") are machined for precision fit with other engine parts including a cylinder head and the pistons (with their piston rings) which reciprocate in high speed contact with the cylinder surfaces in an operating engine. Molds for such castings with internal round cylindrical surfaces have been made of different materials, including sand molds with sand cores for defining internal cylindrical surfaces and permanent metal molds with retractable core pieces (mandrels) for shaping cylindrical surfaces. Such multi-cylinder castings have long been made of cast iron and, in more recent decades, of aluminum alloys, and may be made of magnesium alloys in the future.

Die cast aluminum alloy cylinder blocks for vehicular internal combustion engines, especially gasoline-fueled engines, have been produced for many years. Typically, the cylinder blocks are cast using a silicon-containing aluminum alloy composition that provides suitable fluidity in its molten state for forming the intricate shapes of cylinder blocks with their closely spaced cylinder bores, coolant passages, and other engine block features. But the aluminum alloy compositions have not displayed enough hardness and wear resistance on cylinder surfaces to resist damage by the pistons and rings reciprocating in sliding engagement with the cylinder surfaces in an operating engine. So wear-resistant iron cylinder liners (or of other wear resistant materials) have been placed in the casting mold and the aluminum alloy cast around the liners as the cylinder block is molded. The solidified aluminum composition forms most of the engine block while the cast-in-place liners are anchored to the surrounding aluminum and provide hard cylinder wall surfaces.

Now at least one aluminum alloy composition has been developed that provides both fluidity for casting of engine blocks and wear resistance against piston/ring wear. These alloys may be cast in sand molds with sand cores to make multi-cylinder engine blocks without special wear resistant liners. But for higher production volumes it is desired to use high pressure die casting machines to mold such aluminum alloys. However, when some molten aluminum alloys are forced into direct contact with metal mandrels under high pressure the aluminum composition adheres to the mandrel surfaces. Further, as the material solidifies it shrinks tightly against the mandrels and it is difficult to extract the casting tools from the solidified cylinder block without damaging expensive tools and/or the internal cylindrical surfaces of the casting.

It is an object of this invention to provide a method for high pressure die casting of molten aluminum-base alloys against metal casting tool surfaces (often ferrous metal surfaces) that avoids sticking of the aluminum materials to mandrels or other tool surfaces. The method may also be useful in die casting magnesium alloys or other materials, especially in casting arrangements when the metal shrinks inwardly against the tool surface and otherwise adheres to it.

SUMMARY OF THE INVENTION

In high pressure die casting of aluminum alloy articles permanent metal mold tools are designed and built to receive a charge of molten aluminum alloy that flows against tool surfaces to define the external and internal surfaces of the article. The tools comprise two or more complementary members that are closed to receive the molten metal and cool and solidify it into a desired article shape. The tools are then opened for removal of the solidified article. This process may be repeated many times in the manufacture of many like or identical aluminum cast articles.

When the article has internal surfaces, such as a cylinder block with cylinder bores, one or more casting tool surfaces are used to shape such internal surfaces of the cast article. These tools are often called mandrels and they may be attached to another member of the casting tool for movement into position for a casting operation. The molten metal charge flows against the mandrels (and the other molding surfaces), which may or may not be cooled by internal cooling lines or by spraying the molding surfaces between successive casting operations, and solidifies against the mandrel surfaces to form internal surfaces of the article. After the metal charge has solidified, the casting tools are opened and the mandrels withdrawn from the hollow portions of the article. As stated, under some conditions the molten aluminum may stick to the tool surfaces and as the aluminum solidifies it shrinks against the mandrel or mandrels making it difficult to extract the tools without damaging either the casting or the tools. Of course, cast metal sticking to the mandrel surface alters the specified shape of the molding surface. This problem may be increased when an article, such as a multi-cylinder engine block has two to six closely spaced internal cylinder bores.

A practice of the invention will be illustrated in the embodiment of a multi-cylinder engine block with its several round internal cylinder surfaces. But the method of this invention is obviously applicable to permanent mold casting of other articles with other internal surface shapes. A practice of the invention will also be illustrated using aluminum alloys but the invention may be useful in die casting of magnesium alloys and other alloys.

In practices of this invention, a hollow, relatively thin-wall cylindrical sleeve is prepared of an aluminum alloy (when casting aluminum alloys) for placement over each mandrel or other tool surfaces that are used to form internal cylinder surfaces of the engine cylinder block. For example, the permanent mold tools for a cylinder block with six in-line cylinders will usually have six like-shaped, closely spaced, in-line mandrels attached to a casting tool for defining the internal surfaces of the cylinder block, e.g., the cylinder bores. According to a practice of the invention, a cylindrical sleeve is placed over each mandrel before the die casting tools are closed for receiving a charge of aluminum alloy. The internal diameter of each sleeve enables the sleeve to be easily placed over and fit against an external surface of each mandrel for suitably locating and fixing the sleeve for the molten metal charge. The length of the sleeve and its external diameter are sized to form an internal surface of the casting. Thus, the aluminum alloy sleeves cover the mandrels and provide molding surfaces for the internal cylinder surfaces of the cylinder block.

When cast molten aluminum alloy enters the closed casting tools it flows against the sleeve surfaces and other molding surfaces of the tool. But the internal cylinder surfaces are defined by the respective sleeve outer surfaces. Cast metal solidifies against the sleeves and shrinks against them. The sleeves become part of the cast metal. While cast metal solidifies against other tool surfaces to form external surfaces of the cast article, the metal shrinkage tends to separate cast metal from these external tool surfaces. When the casting tool is re-opened, the mandrels are extracted from the internal surfaces of the aluminum alloy sleeves without sticking, as would be the case had the aluminum solidified directly against the mandrels. As the new casting is removed from the die casting tools, the sleeves adhere to the internal cylinder walls of the engine cylinder block.

Typically several surfaces of a newly cast engine cylinder block are machined for assembly with mating parts of the engine. The cylinder bores of the engine are often carefully machined for roundness and to enlarge them to a diameter for receiving their respective piston/ring assemblies. In such machining operations at least some of the thin wall sleeves are removed from the casting. In preferred embodiments of cast cylinder block manufacture the sleeve is wholly machined away and portions of the cast metal are also removed.

As stated, the sleeve is made of an aluminum alloy. In many embodiments of the invention it may be preferred to make the sleeve of an aluminum alloy composition that is substantially the same as the cast alloy composition. This assures compatibility of the cast alloy with the sleeve surface and permits easy recycling of machining chips from sleeve removal. Alternatively, the sleeve can be made from an alloy that, while not of the same composition as the cast alloy, is of a composition that does not significantly affect the recycling of the chips, for example a lean alloy. Such "lean" alloys might be preferred because they extrude easily and fast, thus enabling low cost, thin sacrificial sleeve manufacturing. Thus, in many practices of the invention, the sleeve is sacrificed in the casting and machining of the article. In these embodiments, the sole function of the sleeve is in protecting mandrel surfaces during casting and separation of the casting from the casting tools.

It will be recognized that the length, internal diameter (or other dimension), and external diameter (or other dimension) of the sleeve are adapted to corresponding casting tool and cast article dimensions.

Other objects and advantages of the invention will be understood from a detailed description of preferred embodiments of the invention.

DESCRIPTION OF PREFERRED EMBODIMENTS

There are numerous technical and economic advantages to using linerless aluminum cylinder blocks, including lower cost, mass reduction, manufacturing reliability, and field durability. However, high pressure, die casting a linerless cylinder block has been problematic.

The bore of the block requires a large core or mandrel (e.g., 75 mm diameter by 140 mm length) and draft is required on the tooling to enable ejection of the block. However, draft (even as small as 1 degree) complicates machining as the depth of cut at the bottom of the bore, thus requiring off-production-line machining to "straighten" the bore for boring and honing. It may also expose subsurface porosity in the casting. In the example of the 140 mm long bore, the difference in bore diameter for a 1 degree draft would be nearly 5 mm. Also, even in the presence of draft, it has been shown that thermal contraction of the aluminum casting during solidification and cooling may cause the block to bind against the mandrels, squeezing them from either end of the six cylinder block, such that ejection of the casting is still not possible without damage to either the casting or the tooling.

This invention is an alternative to draft. It consists of using a thin wall sleeve which fits on the bore mandrel and enables casting and ejecting the linerless block. The sleeve is thin enough that it is removed during subsequent boring and finishing of the cylinder block. Producing this sacrificial sleeve with the same alloy as the cast cylinder block has the advantage of simplifying post-casting machining, manufacturing, and recycling because no handling procedures are necessary, as would be if a sleeve of a different composition (such as steel) were used. The sleeve may be produced by casting and machining or preferably by extrusion; the latter being a lower cost method.

Aluminum alloys suitable for aluminum engine blocks (not requiring wear resistant iron liners or the like) have typically been hyper-eutectic aluminum-silicon compositions, such as A390. This alloy can be die cast, such as in automatic transmission pump bodies and covers, but has not been suitable for die cast engine blocks, at least in part due to the die sticking problems previously outlined. Recently, near-eutectic compositions have shown that they can have the appropriate wear resistance for engine applications. These alloys have 10.5-13 wt % Si with less than 5 wt % other alloying elements added for improved casting and strengthening agents. Recent unpublished reports from Europe show that other manufacturers are pursuing hypo-eutectic aluminum-silicon alloys with 9-10 wt % Si for this application. These alloys are close in comparison to traditional die casting alloys such as A380 or A383. All these alloys would benefit in this application from this invention.

Figure 1:
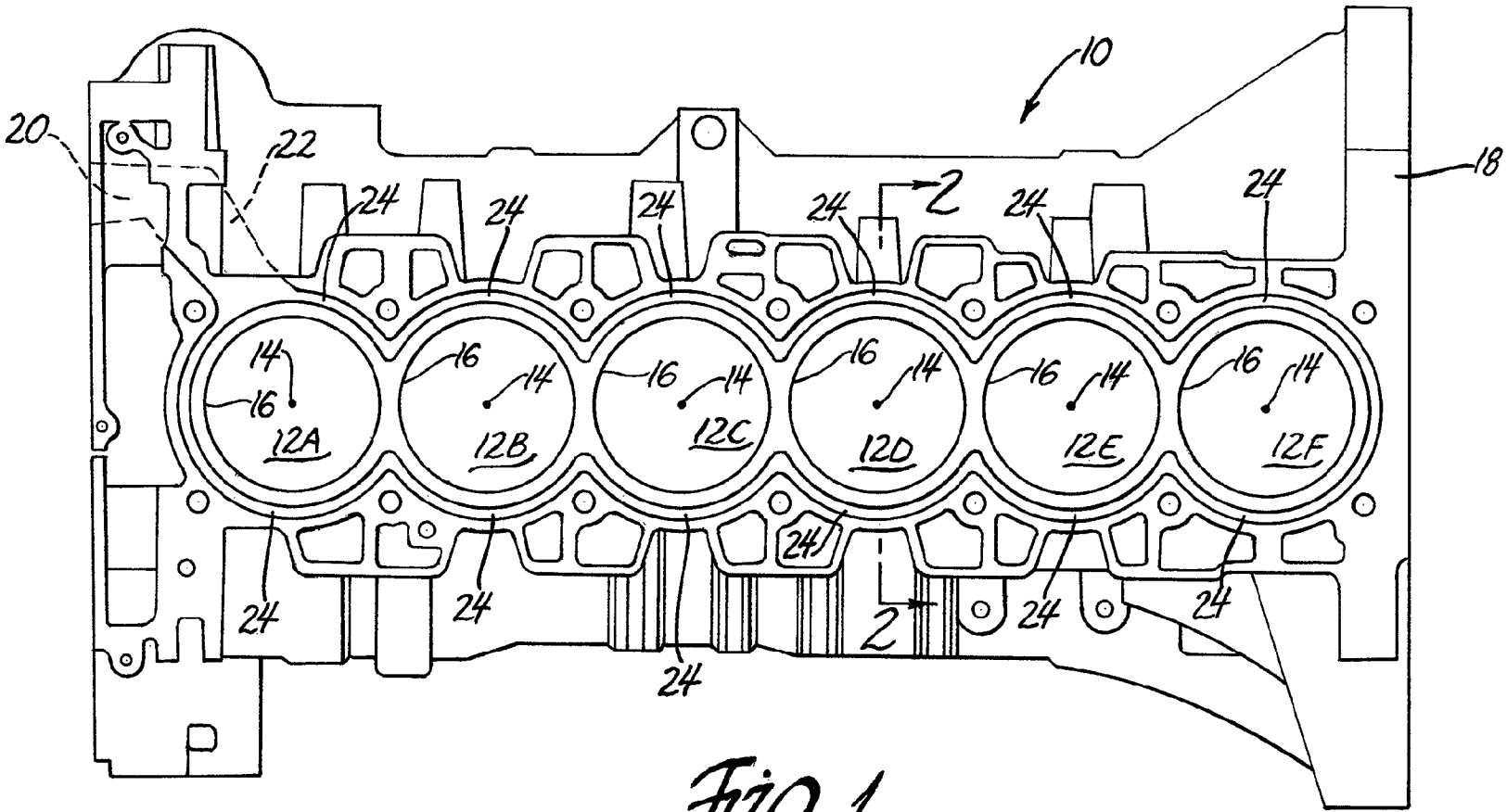
FIG. 1 is a plan view of the upper surface of an aluminum alloy casting for an in-line six cylinder engine cylinder block. This article is representative of a cast article with several internal surfaces that may be advantageously initially formed by high pressure die casting using sacrificial aluminum alloy sleeves in accordance with the invention.

FIG. 1 shows a top view of a cylinder block casting 10 for an in-line, six cylinder, gasoline-fueled, internal combustion engine. The practice of the invention will be described in the example of this particular engine configuration, but the invention is not so limited. In cylinder block 10, the six cylinders 12A through 12F, respectively, are of identical shape and size, and the longitudinal axes (seen as points 14 in FIG. 1) of the cylinders are parallel, equi-spaced and co-planar. In this illustration the cylinder block is a Siamese-type block because there are no coolant passages formed in the five shared walls 16 between the six in-line cylinders 12A-12F. Because of the close alignment of the six cylinders, it has been difficult to cast this block on high pressure die cast tooling and remove the block from the six closely spaced mandrels.

Cylinder block 10 has a flat top deck portion 18. As is well known in the assembly of an engine, a cylinder head and head gasket, neither shown, are bolted to cylinder block 10 against deck surface 18. The cylinder head provides the upper or ceiling portion of each combustion chamber associated with each cylinder. Air/fuel intake valves, exhaust valves and a spark plug for each cylinder are associated with the cylinder head. Of course, a piston with its connecting rod, not shown, will be assembled in each cylinder 12A-12F. The lower end of each connecting rod is connected to a crankshaft, not shown, which is partially contained in the lower portion of cylinder block 10. A crank case, not shown, bolted to the lower deck of block 10 encloses the rest of the crankshaft.

The required shape of the block is made more complex by the need for cooling. A conventional liquid coolant comprising water and ethylene glycol or propylene glycol is pumped with a water pump, not shown, through coolant passages in the cylinder block 10. In the embodiment shown in FIG. 1, coolant enters at passage inlet 20 at one end of the line of cylinders, near cylinder 12A. The coolant flow splits at 22 and flows through passages 24 around portions only of the circumferential walls that define each cylinder. Since there are no coolant passages in common cylinder wall portions 16 of the line of six cylinders 12A-12F, the coolant flow is along the sides only of the line of cylinders. Coolant may exit the block and enter the cylinder head, not shown. It has proven difficult to make cylinder block 10 by die casting without using this invention. Ejection of the casting from the casting tools often damages the cylinder surfaces and adjacent cooling passages such that cracks permit leakage and rejection of the castings.

This invention is used in high pressure, aluminum alloy die casting of a cylinder block like that shown in FIG. 1 having one (and usually more) internal cylinder surfaces shaped by a metal tool surface.

Figure 2:
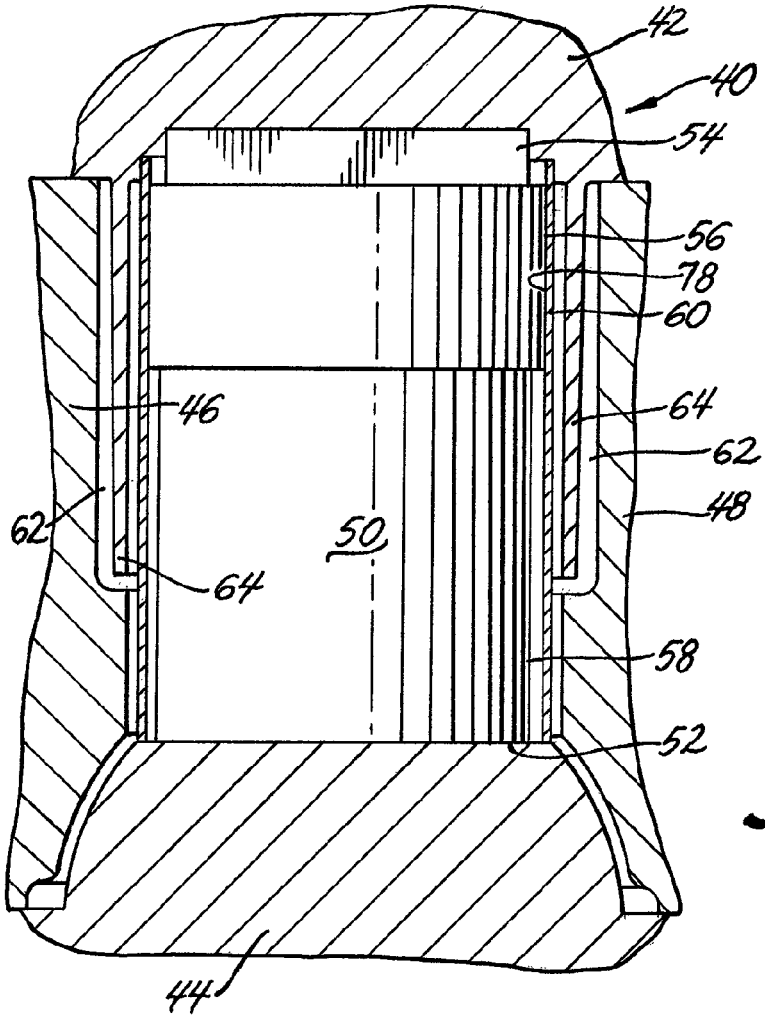
FIG. 2 is a cross-sectional view of a portion of die casting tools including a mandrel and sacrificial aluminum alloy sleeve for casting of the internal cylinder surface region of the cylinder block of FIG. 1 at the section indicated at location 2-2.

FIG. 2 illustrates a fragmentary portion of permanent mold tools for high pressure die casting of a multi-cylinder engine block such as is illustrated in FIG. 1. The portion of tooling illustrated is for casting a portion of one of the cylinder surfaces (12D) at a region indicated at 2-2 of FIG. 1.

In FIG. 2, a portion of multimember die casting mold tooling 40 is illustrated in the "die closed" posit ion. The multi-member mold tooling comprises an upper die member 42 (with two partially rounded cores 64 for forming cooling passages at sides of the cylinder bore), a lower die member 44, and side die members 46 and 48. These die members are formed (typically machined) of a suitable steel composition to withstand a high pressure die casting operations and exposure to die castable molten aluminum alloy. Portions of these members (or others, not shown) may be heated by means not shown to accommodate a charge of the molten alloy, and portions of the members (or others, not shown) may be cooled by means not shown to facilitate solidification of the molten charge after it has suitably filled the casting cavity defined by such permanent mold tool members. Some of the tool members are movable relative to others from a die open position, not shown, to the illustrated die closed position.

Standing on lower die 44 is a generally round cylindrical mandrel 50. Mandrel 50 has a flat bottom surface 52 for standing on lower die member 44 and an upper tab member 54 for locking engagement with upper die member 42. Mandrel 50 has an upper round cylindrical surface 56 and a lower round cylindrical surface 58. Upper cylindrical surface 56 has a slightly greater diameter than lower cylindrical surface 58 for a reason that will soon be apparent.

A hollow, round, relatively thin wall, cylindrical sleeve 60 has been placed over mandrel 50. One end of the cylindrical sleeve rests on lower tool 44. As seen in FIG. 2, an upper portion of the positioned sleeve 60 fits closely against upper cylindrical surface 56 of mandrel 50, and a lower portion of the positioned sleeve is spaced from lower cylindrical surface 58 of mandrel 50. In this illustration, the proportion of surface contact (e.g., relative lengths of surfaces 56, 58) between sleeve 60 and mandrel 50 is for securely positioning sleeve 60 for die casting but enabling facile removal of the sleeve and casting when the die members are opened for casting removal. In the closed position of the die members the upper end of sleeve 60 is engaged and secured by upper die member 42.

In the die-closed position, with sleeve 60 in place on mandrel 50, a casting cavity 62 is formed between facing portions of die members 42, 44, 46, 48, and sleeve 60. Core members 64 which are part of upper tool 42 form cooling passages like passages 24 in FIG. 1. Core members 64 may be tapered from top to bottom to facilitate withdrawal from the cast metal. Of course, FIG. 2 shows only a portion of the total die casting cavity for forming cylinder block 10 of FIG. 1. FIG. 2 illustrates the use of a sleeve 60 in forming a single cylinder surface, for example cylinder 12 D at region 2-2 of FIG. 1.

Figure 3:
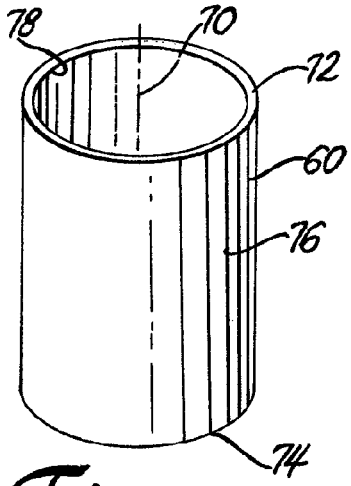
FIG. 3 is an oblique view of a hollow thin-wall aluminum alloy sleeve as used with the die cast tooling shown in FIG. 2.

FIG. 3 is an oblique view of hollow, thin wall, round cylinder sleeve 60. Six such sleeves and six mandrels (like 50 in FIG. 2) are used in the casting of the six cylinder surfaces 12A-12F in making cylinder block 10 of FIG. 1. In this embodiment of the invention, each round sleeve 60 has longitudinal central axis 70. The aluminum alloy wall constituting sleeve 60 has two ends 72, 74 which, in this illustration, are perpendicular to central axis 70. Each sleeve 60 has an outer surface 76 with a diameter predetermined to define an "as cast" inner diameter for the cylinder surface of cylinder block casting. The length of sleeve 60 between ends 72, 74 is equal to or greater than the length of the cylinder surface of the casting. The length of sleeve 60 may be longer than the length of the casting surface in order to secure sleeve 60 between die casting tools 42, 44. The thickness of the aluminum alloy wall of sleeve 60 is determined so that the sleeve can withstand the impact of the die cast charge of molten aluminum alloy and become bonded to the cast metal without melting or distortion. Thus, the size and shape of a supporting mandrel (mandrel 50 in FIG. 2) and the diameter of inner surface 78 of sleeve 60 are a function of the desired thickness of the sleeve in a die casting application. In general, the thickness of sleeve liners used in the practice of this invention will be no more than about four millimeters.

Sleeves as used in accordance with this invention (like sleeve 60) are suitably formed of an aluminum alloy to be compatible with the composition of the cast alloy. Preferably the aluminum alloy compositions of the sleeve and cast material are substantially the same. The thin wall sleeves may be made, for example, by extrusion of an ingot into the sleeve shape, or by machining of a cast ingot of the aluminum alloy, or by casting hollow forms. The sleeves may have positive or negative features on their outside surface that permit molten metal to flow into or around them and become locked with these features upon solidification in the die. These small interlocks would provide additional locking of the sleeve to the engine block casting to ensure that the sleeves will always come out with the casting when the latter is extracted.

When the sleeves are to be made by extrusion, the positive or negative features can be easily formed onto the extrusion outside surface with a simple die modification. The extrusion can also be twisted to ensure that these features adopt a spiral configuration so that the locked regions are no longer in line with the direction of extraction of the mandrel. The locking features will be designed to be fairly shallow to not interfere with the subsequent machining process to form the final bore of the engine.

When the sleeves are to be made by casting, these features can also be made easily and in any desirable configuration relative to the direction of extraction of the mandrel, or by casting hollow forms.

As stated, a portion of the die cast molten aluminum alloy bonds to each mandrel-protecting sleeve used in making the casting. After the cast metal has solidified and suitably hardened, the die cast machine mold elements are opened and the casting with its bonded sleeve liners removed from the casting machine. A new set of sleeve liners is then applied to the mandrels and the machine is otherwise prepared for an immediately following casting operation. The removed casting is allowed to cool and is prepared for finishing operations, such as cleaning and machining, to complete manufacture of the casting. These finishing operations will include removal of some or all of the bonded sleeves by suitable machining. Preferably the entire bonded sleeve is machined from the casting.

Figure 4:
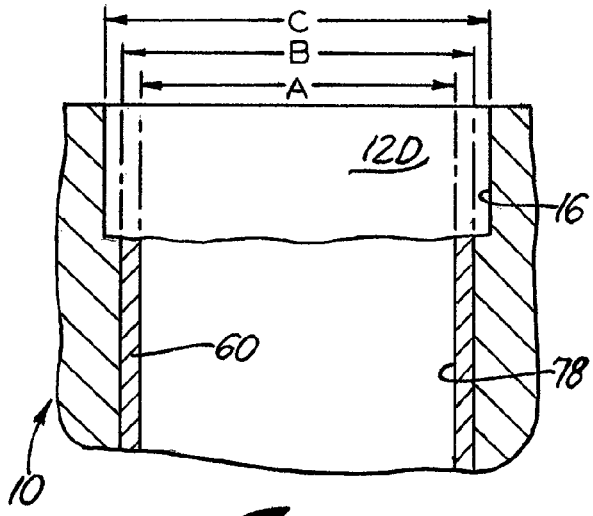
FIG. 4 is a fragmentary cross-sectional view of an as-cast cylinder block preparatory to machining, illustrating removal of a sacrificial liner and a portion of the cast cylinder wall surface.

FIG. 4 illustrates a small portion of a cylinder region of a cast cylinder block such as cylinder surface 12D of cylinder block 10 of FIG. 1. In FIG. 4, sacrificial sleeve 60 is seen bonded to the casting wall of what, after suitable machining, will be cylinder surface 16 of cylinder bore 12D of cylinder block 10. In this illustration, the inside diameter (dimension A in FIG. 4) of sleeve is typically in the range of about 60 to 70 mm. The thickness of sleeve 60 is typically about one to four millimeters to arrive at a predetermined outside diameter, dimension B in FIG. 4. The desired inside diameter of finished cylinder surface 16 of cylinder bore 12D is indicated as dimension C in FIG. 4. Each cylinder of the cast block is subjected to boring operations, or the like, to remove the mandrel-protecting sleeve 60 and additional cast material to arrive at cylinder surface dimension C. Such machining operations are determined for each cast part in order, for example, to shape internal cylinder surface(s) of the die cast part to a suitable dimension and degree of roundness, and to expose a suitable cast aluminum alloy microstructure for the intended function of the internal cylinder surface.

A practice of the invention has been illustrated with round sleeves protecting round die casting machine mandrels. Obviously, other internal cylinder surfaces may have different shapes and, accordingly, different casting tool shapes and different protective sleeve shapes will be devised and used. In many die casting operations (but not necessarily all embodiments of the invention) the protective sleeve is completely machined from the internal surface of the casting. In these embodiments of the invention, each sleeve is sacrificed after it has served its function of protecting the precision die casting tool from erosion or distortion by molten cast metal.

The invention claimed is:

1. A method of die casting an aluminum alloy article of predetermined composition and having an internal cylindrical wall surface, the cylindrical wall surface having at least one predetermined internal cross-section dimension and a height, the method comprising:

providing a die casting tool having a cylindrical surface portion, the cylindrical surface portion having a height for forming the cylindrical surface of the article and a cross-section smaller than the cross-section of the cylindrical wall surface;

placing a hollow cylindrical sleeve liner on the cylinder surface portion of the tool, the liner having a thickness, a height, a cross-section shape, and an outer surface for defining the internal cylindrical wall surface of the article, the hollow liner being formed of an aluminum alloy;

casting a melt of the aluminum alloy of the article against the outer surface of the sleeve liner, the melt solidifying against the liner surface and bonding to it, the thickness of the sleeve liner being predetermined to resist melting or distortion by the cast aluminum alloy before the cast alloy solidifies;

removing the cast article and bonded cylindrical sleeve liner from the die casting tool; and machining the entire cylindrical sleeve liner from the internal surface of the cast article to form the internal cylindrical surface of the article.

2. A method of die casting an aluminum alloy article as recited in claim 1 in which the aluminum alloy article has two or more internal cylindrical wall surfaces and a hollow cylindrical sleeve liner is used in casting each internal cylindrical wall surface.

3. A method of die casting an aluminum alloy article as recited in claim 1 in which the liner has a thickness no greater than about four millimeters.

4. A method of die casting an aluminum alloy article as recited in claim 1 in which the composition of the liner is substantially the same as the aluminum alloy composition of the cast article.

5. A method of die casting an aluminum alloy article as recited in claim 1 in which the sleeve liner has surface features formed on its outer surface for interlocking bonding with cast melt upon solidification of the cast melt.

6. A method of die casting an aluminum alloy article or magnesium alloy article of predetermined composition and having an internal round cylinder wall surface, the round cylinder surface having a predetermined internal diameter and height, the method comprising:

providing a die casting tool having a round cylinder surface portion, the round cylinder portion having a height for forming the round cylinder surface of the article and a diameter smaller than the internal diameter of the cylinder surface;

placing a hollow round cylindrical liner on the round cylinder tool surface, the liner having a height and an outer surface with an outer diameter for defining the internal round cylinder wall surface of the article;

casting a melt of the aluminum alloy or magnesium alloy against the outer surface of the liner, the melt solidifying against the liner surface and bonding to it, the thickness of the liner being predetermined to resist melting or deformation by the cast aluminum alloy or magnesium alloy before the cast alloy solidifies;

removing the cast article and bonded liner form the die casting tool; and machining the entire cylindrical liner from the internal surface of the cast article to form the round internal cylindrical surface of the article.

7. A method of die casting an aluminum alloy or magnesium alloy article as recited in claim 6 in which the article is a multi-cylinder engine cylinder block and a separate casting tool and a separate hollow round cylindrical liner are used in forming each internal cylindrical surface of the cylinder block.

8. A method of die casting an aluminum alloy or magnesium alloy article as recited in claim 6 in which the liner has a thickness no greater than about four millimeters.

9. A method of die casting an aluminum alloy article as recited in claim 6 in which the composition of the liner is substantially the same as the aluminum alloy composition of the cast article.

10. A method of casting a cylinder block as recited in claim 7 in which the bonded liner is machined from each cylinder surface and additional cast material is machined from each cylinder surface.

* * * * *